US006862993B1

(12) United States Patent
Cudazzo

(10) Patent No.: US 6,862,993 B1
(45) **Date of Patent: *Mar. 8, 2005**

(54) SHELL FOR BULLETS OF AUTOMATIC OR SEMIAUTOMATIC FIREARMS WITH INTERTIAL CLOSURE

(75) Inventor: Antonio Cudazzo, Milan (IT)

(73) Assignee: Giuseppina Scarcella, Milan (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,268

(22) Filed: Feb. 17, 1998

(30) Foreign Application Priority Data

Feb. 24, 1997 (IT) ..... MI97A0396

(51) Int. Cl.[7] ..... F42B 5/28

(52) U.S. Cl. ..... 102/464; 102/469; 102/430

(58) Field of Search ..... 102/464, 469, 102/470, 430, 465–468, 447; 29/1.3, 1.31; 42/25; 89/194–196

(56) References Cited

U.S. PATENT DOCUMENTS

| | | | | | |
|---|---|---|---|---|---|
| 120,338 | A | * | 10/1871 | Smoot | 102/469 |
| 160,763 | A | * | 3/1875 | Freund | 102/469 |
| 345,165 | A | * | 7/1886 | Moose | 102/469 |
| 398,823 | A | * | 3/1889 | Emmons | 102/470 |
| 1,062,604 | A | * | 5/1913 | Pedersen | 102/464 |
| 2,263,941 | A | * | 11/1941 | Albree | 102/464 |
| 3,477,374 | A | * | 11/1969 | Barr | 102/470 |
| 3,498,221 | A | * | 3/1970 | Hilton et al. | 102/464 |
| 3,659,528 | A | * | 5/1972 | Santala | 102/468 |
| 3,765,297 | A | * | 10/1973 | Skochko et al. | 102/469 |
| 3,791,301 | A | * | 2/1974 | La Costa | 102/470 |
| 3,797,396 | A | | 3/1974 | Reed | |
| 4,483,251 | A | | 11/1984 | Spalding | |
| 5,033,386 | A | * | 7/1991 | Vatsvog | 102/469 |
| 5,094,169 | A | | 3/1992 | Evitts | |
| 5,187,324 | A | * | 2/1993 | Ricco, Sr. | 102/469 |
| 5,507,232 | A | | 4/1996 | Valdez | |

FOREIGN PATENT DOCUMENTS

| | | | | |
|---|---|---|---|---|
| AT | 234555 | * | 7/1964 | 102/469 |
| CA | 474422 | * | 6/1951 | 102/469 |
| CA | 474423 | * | 6/1951 | 102/470 |
| DE | 68607 | * | 5/1893 | 102/430 |
| FR | 655854 | * | 4/1929 | 102/469 |
| FR | 911 696 | | 7/1946 | |
| FR | 1 140 147 | | 7/1957 | |
| GB | 3303 | * | 11/1869 | 102/470 |

* cited by examiner

*Primary Examiner*—Michael J. Carone
*Assistant Examiner*—James S. Bergin
(74) *Attorney, Agent, or Firm*—Guido Modiano; Albert Josif; Daniel O'Byrne

(57) ABSTRACT

A shell for bullets of automatic or semiautomatic firearms with inertial closure, comprising a hollow cylindrical body which is closed, at one of its axial ends, by a head and is adapted to accommodate a bullet at the opposite axial end, the head being centrally provided with a cap that accommodates the primer. At least the portion of the shell which is extracted from the firing chamber when the fired bullet leaves the barrel is provided with reinforcement means to prevent accidental bursting of the shell at the end of the firing action and when the extraction of the shell from the firing chamber begins.

2 Claims, 1 Drawing Sheet

SHELL FOR BULLETS OF AUTOMATIC OR SEMIAUTOMATIC FIREARMS WITH INTERTIAL CLOSURE

BACKGROUND OF THE INVENTION

The present invention relates to a shell for bullets of automatic or semiautomatic firearms with inertial closure, particularly for medium- or large-caliber pistols.

Conventional semiautomatic or automatic pistols with inertial closure have a sliding breech which is supported by the frame of the pistol so that it can slide in a direction which is parallel to the axis of the barrel.

Such conventional pistols with inertial closure being of the type having an internally cylindrical stationary barrel with a cylindrical firing chamber for the shell. As is well known in the art, upon firing at the moment when the fired bullet leaves the barrel the shell, if not delayed, moves backwards with the sliding breech thereby to initially outwardly expose a portion of the shell protruding initially outwardly from the chamber of the barrel thereby defining an initially protruding length of the shell.

The magazine with the cartridges is generally accommodated in the butt of the pistol and in each instance one cartridge is moved at the region where the sliding breech operates.

In practice, the sliding breech is movable from a backward position, for allowing the entry of the cartridge transferred from the magazine, to a forward position wherein it closes the firing chamber to the rear. In passing from the backward position to the forward position, the sliding breech engages the cartridge and inserts it in the firing chamber. When it moves in the opposite direction, the sliding breech, by means of an element known as extractor, engages the collar of the shell and removes the shell from the firing chamber, also expelling it through an adapted opening formed laterally or in an upward region in the body of the sliding breech.

The backward movement of the sliding breech is contrasted elastically by a spring, arranged around the barrel, which causes the advancement of the sliding breech.

In these weapons the problem arises of delaying the backward motion of the sliding breech to prevent shell extraction from the firing chamber from beginning before the bullet has left the barrel, i.e., in the presence of very high pressures inside said barrel. If the shell is extracted from the firing chamber whilst the pressure inside said firing chamber is still very high, the shell can burst, causing danger to the user and at the same time jamming the weapon.

Various measures have been adopted to solve this problem.

One of these measures consists in increasing the mass of the sliding breech so that the backward movement of the sliding breech is delayed due to the high inertia caused by its increased mass.

This measure entails some drawbacks, since it increases the weapon weight; moreover, oscillations of the weapon induced by the movement of the sliding breech at the end of its forward and backward movement are observed. These oscillations and the considerable weight of the weapon negatively affect firing precision and the oscillations of the weapon cause the user to lose his line of fire during closely spaced repeat firing.

Another measure consists in forming the moving barrel together with the sliding breech. In practice, during firing the barrel retracts rigidly with the sliding breech by a first extent, so that the sliding breech keeps the firing chamber closed, and then releases the sliding breech so that it ends its backward movement, extracting and expelling the shell.

This measure, too, is not free from drawbacks, since it complicates the structure of the pistol and also increases its production costs. Moreover, the coupling between the barrel and the frame of the pistol and between the barrel and the sliding breech must be performed with considerable play in order to allow the various movements, and these plays inevitably affect the precision of the weapon. In order to obviate this drawback, it is often necessary to manually modify the weapon with highly specialized operations that entail very high costs.

Another measure consists in using the gases produced during firing inside the firing chamber or the barrel, providing an adapted duct with an inlet located in the firing chamber or almost at the end of the barrel in order to deactivate an element which temporarily locks the sliding breech.

This measure considerably affects the production cost of the pistol and reduces the reliability of the weapon, since the gas conveyance duct can clog after a certain number of shots, thus jamming the weapon. The flow of the gases also generates turbulence which reduces the weapon precision.

SUMMARY OF THE INVENTION

The aim of the present invention is to solve the above problems by providing a shell for bullets of automatic or semiautomatic firearms with inertial closure, which effectively avoids the danger of bursting when it is extracted from the firing chamber without requiring the adoption of particular measures in the structure of the weapon.

Within the scope of this aim, an object of the present invention is to provide a shell which solves the problem of bursting during its extraction from the firing chamber without requiring an increase in the mass of the sliding breech.

Another object of the present invention is to provide a shell which solves the problem of bursting during extraction from the firing chamber without requiring devices for locking the sliding breech or measures for delaying the backward movement of the sliding breech.

Another object of the present invention is to provide a shell which does not penalize the precision and reliability of the weapon.

This aim, these objects, and others which will become apparent hereinafter are achieved by a shell for bullets of automatic or semiautomatic firearms with inertial closure, comprising a hollow cylindrical body which is closed, at one of its axial ends, by a head and is adapted to accommodate a bullet at the opposite axial end, said head being centrally provided with a cap that accommodates the primer, characterized in that at least the portion of the shell which is extracted from the firing chamber when the fired bullet leaves the barrel is provided with reinforcement means.

BRIEF DESCRIPTION OF THE DRAWINGS

Further characteristics and advantages of the present invention will become apparent from the description of two preferred but not exclusive embodiments of the shell according to the invention, illustrated only by way of non-limitative example in the accompanying drawings, wherein.

DESCRIPTION OF THE PREFERRED EMBODIMENTS

Figure 1:
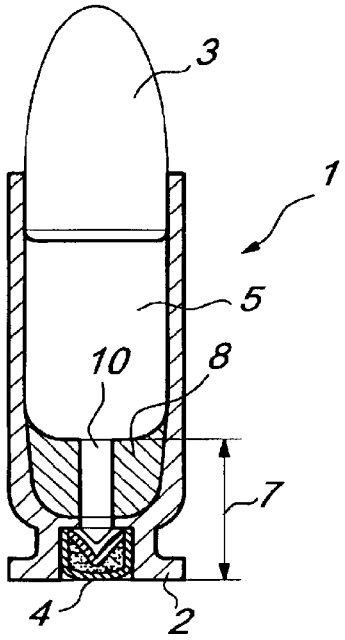
FIG. 1 is an axial sectional view of the shell according to the present invention in a first embodiment.

With reference to the above figures, the shell according to the present invention, designated by the reference numerals 1 and 1*a* in its two embodiments, comprises a substantially cylindrical hollow body which is closed, at one of its axial ends, by a head 2 and is adapted to accommodate a bullet 3 at the opposite axial end.

The head 2 is centrally provided, in a per se known manner, with a cap 4 containing the primer.

Inside the shell 1 there is provided a cavity 5, 5*a* meant to accommodate the firing charge.

A channel 10 is defined between the cavity 5, 5*a* and the cap 4.

According to the invention, at least the portion of the shell which is extracted from the firing chamber when the fired bullet 3 leaves the barrel 6 is provided with reinforcement means.

Said portion is designated by the reference numerals 7 and 7*a* in the figures.

As shown in the first embodiment, said reinforcement means can be constituted by an annular body 8 which is forced inside the shell body or is cast directly in the shell body, according to requirements. The annular body 8 can be preferably made of light material, such as for example an aluminum alloy.

As shown in the second embodiment, the means for reinforcing the portion 7*a* can be constituted simply by an increase in the thickness of the walls at the portion 7*a*.

Both the annular body 8 and the increase in thickness at the portion 7, 7*a* preferably blend with the remaining part of the inner side walls of the shell towards the end that is associated with the bullet 3.

The length of the portion 7, 7*a*, measured starting from the head 2, can be different according to the time that elapses between the beginning of the firing action and the instant when the fired bullet 3 leaves the barrel 6. This time depends on various parameters, such as the type of firing charge being used, the weight of the bullet 3, the type of coupling between the bullet 3 and the inside of the barrel 6, the length of the barrel 6, the mass of the sliding breech, and the weight of said shell 1, 1*a*. In any case, the length of the portion 7, 7*a* is such that when the sliding breech has started to extract the shell 1, 1*a* from the firing chamber 9 and the bullet 3 leaves the barrel 6, the shell 1, 1*a* is extracted from the firing chamber 9 by an extent which is substantially equal to, or slightly smaller than, the length of the portion 7, 7*a*.

In this manner, owing to the fact that when the explosion pressure inside the firing chamber 9, acting also within the channel 10 of the shell, decreases, the shell is extracted from the firing chamber by an extent which is substantially equal to the length of the portion 7, 7*a*, accidental bursting of the shell is effectively avoided.

Figure 2:
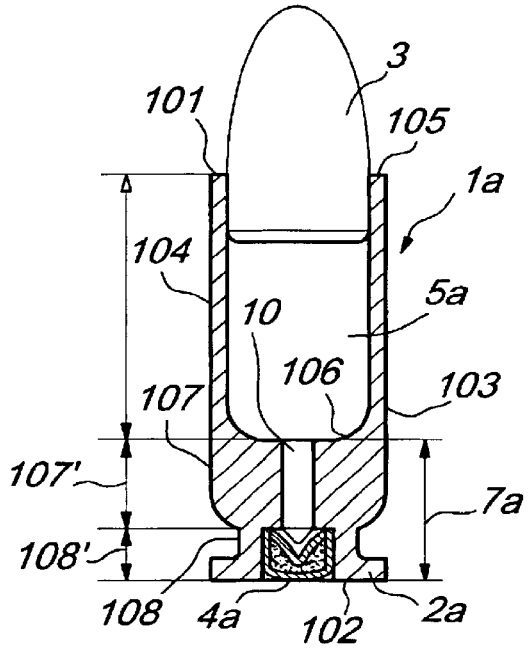
FIG. 2 is an axial sectional view of the shell according to the present invention in a second embodiment.
Figure 3:
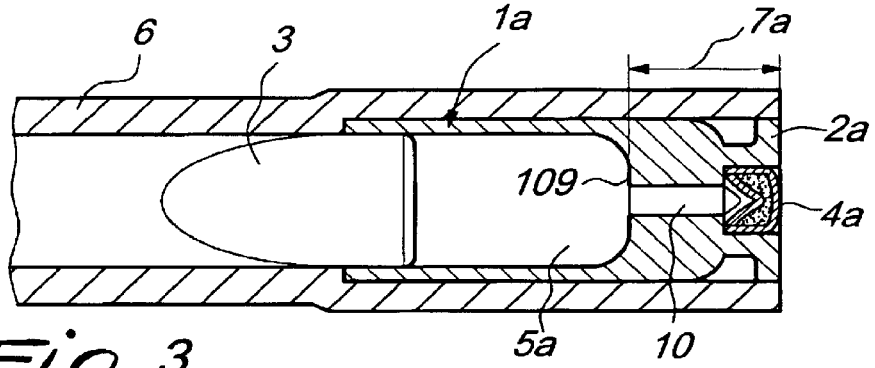
FIG. 3 is a schematic view of the shell inserted in the firing chamber of the barrel of a weapon.

To summarize and as best visible from FIG. 3, the shell has a substantially cylindrical shape corresponding to the cylindrical shape of the cylindrical firing chamber 9 thereby to be located totally within the firing chamber prior to firing. As best visible from FIG. 2 of the drawing, the shell has a forward end 101 and a rear end 102 and is in the form of a one-piece body 103. The body 103 comprises a hollow outwardly cylindrical body portion 104 defining the cavity 5*a* for the firing charge and has forwardly an open end 105 for accommodating a bullet 3 therein closing said cavity 5*a* and a bottom 106 opposite to said open end 105.

The one-piece body 103 comprises further a solid outwardly essentially cylindrical explosion pressure absorbing body portion 107 extending from said bottom 106 of said hollow outwardly cylindrical body portion 104 and integral therewith, said solid outwardly essentially cylindrical explosion pressure absorbing body portion 107 defining said bottom 106 for said cavity 5*a*, said bottom 106 having centrally a planar formation 109 as best visible in FIG. 3.

Figure 4:
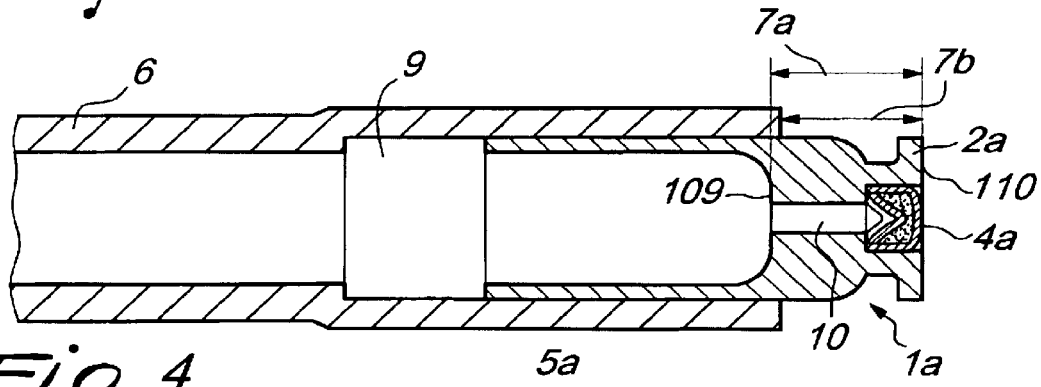
FIG. 4 is a schematic view of the initial step of the extraction of the shell according to the present invention from the firing chamber.

The one piece body 103 comprises further a flange shaped head portion 108 including an extraction groove extending from said solid essentially cylindrical explosion pressure absorbing body portion 107 and defining at said rear end 102 of the shell 1*a* a rear end surface 110 of the shell 1*a*, as best visible in FIG. 4.

The flange shaped head portion 108 has a pocket or cap 4*a* for a primer, whereas the solid outwardly essentially cylindrical explosion pressure absorbing body portion 107 has a channel 10 opening into and extending from said pocket 4*a* up to and opening into said cavity 5*a* at said planar formation 109 of said bottom 106.

Note that from the drawing it appears further that the channel diameter to cavity diameter ratio amounts to about 0.25 and the channel length to head portion length ratio amounts to about 1.75.

As best visible in FIG. 2 said solid outwardly essentially cylindrical explosion pressure absorbing body portion 107 has a first longitudinal extent (107') equal to the length of the channel 10 and said flange shaped head portion (108) has a second longitudinal extent (108') including the extraction groove, the sum of said first and second longitudinal extents (107'and 108') measured from said planar formation (109) up to said rear end surface (110) of the shell (1*a*) defining a length (7*a*) of the shell. For reference purposes the length 7*a* will be called safety length 7*a* of the shell, in view of the solid structure and explosion pressure absorbing effect of the considered component part. In order for the safety length 7*a* to achieve its purpose, it is sufficient that such safety length 7*a* of the shell is substantially equal to said initially protruding length (7*b*) of the shell.

The problem of avoiding accidental bursting of the shell is thus solved without having to increase the weight of the sliding breech and without providing special devices.

Consequently, the weapon can be lighter than conventional weapons using these measures, to the full advantage of the structural simplicity of the weapon and of firing precision.

It should be noted that the basic concept of the present invention can even lead to a weight reduction in weapons, since the mass of the sliding breech can be reduced adequately. Although the present invention has been conceived in particular for shells of medium- or large-caliber cartridges, this advantage is particularly appreciated in small- and very small-caliber weapons.

Optionally, in order to give the cavity 5, 5*a* meant to contain the firing charge a volume which is equal to the volume of cavities of conventional shells, the shell according to the present invention can be slightly longer than conventional shells. However, this requirement does not entail a structural complication of the weapon, since it is sufficient to make the firing chamber 9 slightly longer than firing chambers of conventional weapons.

In practice it has been observed that the shell according to the present invention fully achieves the intended aim, since it solves the problem of the accidental bursting of the shell when it begins to be extracted from the firing chamber without entailing an increase in the weapon weight and without making the weapon structurally more complicated.

Although the basic concept of the present invention has been studied in particular for automatic or semiautomatic medium- or large-caliber pistols, it can nonetheless be used in a wide variety of pistols or in other firearms featuring inertial closure.

The shell thus conceived is susceptible of numerous modifications and variations, all of which are within the scope of the inventive concept; all the details may also be replaced with other technically equivalent elements.

In practice, the materials employed, so long as they are compatible with the specific use, as well as the dimensions, may be any according to requirements and to the state of the art.

What is claimed is:

1. A shell for bullets exclusively for automatic or semiautomatic pistols with an inertial closure having an internally cylindrical barrel with a cylindrical firing chamber for the shell and a sliding breech, the pistols allowing that upon firing at the moment when the fired bullet leaves the barrel the shell moves backwards with the sliding breech thereby to initially outwardly expose a portion of the shell protruding initially outwardly form the chamber of the barrel thereby defining an initially protruding length of the shell, the shell having a substantially cylindrical shape corresponding to the cylindrical shape of said cylindrical firing chamber thereby to be located totally within the firing chamber prior to firing the shell comprising:

a forward end and a rear end and a peripheral extraction groove near said rear end and being in the form of a one-piece body including a hollow outwardly cylindrical body portion defining an essentially cylindrical cavity for the firing charge and having forwardly an open end for accommodating a bullet therein closing said essentially cylindrical cavity and a bottom opposite to said open end, said essentially cylindrical cavity having a cavity diameter, a solid outwardly essentially cylindrical explosion pressure absorbing body portion integral with said shell and extending from said bottom of said hollow outwardly cylindrical body portion up to said peripheral extraction groove said solid outwardly essentially cylindrical explosion pressure absorbing body portion defining said bottom for said essentially cylindrical cavity, said bottom having centrally a planar formation, a flange shaped head portion including said peripheral extraction groove and extending rearwards from said solid outwardly essentially cylindrical explosion pressure absorbing body portion and defining at said rear end of the shell a rear end surface of said shell, said head portion having a pocket for a primer and said solid outwardly essentially cylindrical explosion pressure absorbing body portion having a channel extending centrally throughout said solid outwardly essentially cylindrical explosion pressure absorbing body portion from said pocket towards said essentially cylindrical cavity and opening into said essentially cylindrical cavity at said planar formation of said bottom, said channel having a channel forward end opening into said essentially cylindrical cavity, a channel rear end opening into said pocket, a channel length extending from said channel forward end up to said channel rear end, a channel diameter, said channel diameter being substantially smaller than said cavity diameter thereby to expose to explosion pressure a surface area determined by said channel diameter and said channel length;

said solid outwardly essentially cylindrical explosion pressure absorbing body portion having a first longitudinal extent corresponding to said channel length and said flange shaped head portion having a second longitudinal extent extending from said channel rear end up to said rear end surface of said shell, said first longitudinal extent being substantially greater than said second longitudinal extent, the sum of said first and second longitudinal extents measured from said planar formation up to said rear end surface of the shell defining a safety length of the shell, said safety length of the shell being substantially equal to said initially protruding length of the shell.

2. A shell for bullets exclusively for automatic or semiautomatic pistols with an inertial closure having an internally cylindrical barrel with a cylindrical firing chamber for the shell and a sliding breech, the pistols allowing that upon firing at the moment when the fired bullet leaves the barrel the shell moves backwards with the sliding breech thereby to initially outwardly expose a portion of the shell protruding initially outwardly form the chamber of the barrel thereby defining an initially protruding length of the shell, the shell having a substantially cylindrical shape corresponding to the cylindrical shape of said cylindrical firing chamber thereby to be located totally within the firing chamber prior to firing, the shell comprising:

a forward end and a rear end and a peripheral extraction groove near said rear end and being in the form of a one-piece body including:

a hollow outwardly cylindrical body portion defining an essentially cylindrical cavity for the firing charge and having forwardly an open end for accommodating a bullet therein closing said essentially cylindrical cavity and a bottom opposite to said open end, said essentially cylindrical cavity having a cavity diameter, a solid outwardly essentially cylindrical explosion pressure absorbing body portion integral with said shell and extending from said bottom of said hollow outwardly cylindrical body portion up to said peripheral extraction groove, said solid outwardly essentially cylindrical explosion pressure absorbing body portion defining said bottom for said essentially cylindrical cavity, said bottom having centrally a planar formation, a flange shaped head portion including said peripheral extraction groove and extending rearwards from said solid outwardly essentially cylindrical explosion pressure absorbing body portion and defining at said rear end of the shell a rear end surface of said shell, said head portion having a pocket for a primer and said solid outwardly essentially cylindrical explosion pressure absorbing body portion having a channel extending centrally throughout said outwardly essentially cylindrical explosion pressure absorbing body portion from said pocket towards said essentially cylindrical cavity and opening into said essentially cylindrical cavity at said planar formation of said bottom, said channel having a channel forward end opening into said essentially cylindrical cavity, a channel rear end opening into said pocket, a channel length extending from said channel forward end up to said channel rear end, a channel diameter, said channel diameter being substantially smaller than said cavity diameter thereby to expose to explosion pressure a surface area determined by said channel diameter and said channel length, the ratio between said channel diameter and said cavity diameter amounting to about 0.25;

said solid outwardly essentially cylindrical explosion pressure absorbing body portion having a first longitudinal extent equal to said channel length and said flange shaped head portion having a second longitudinal extent extending from said channel rear end up to said rear end surface of said shell, said first longitudinal extent being substantially greater than said second longitudinal extent, the ratio between said first and second longitudinal extents amounting to about 1.75; the sun of said first and second longitudinal extents measured from said planar formation up to said rear end surface of the shell defining a safety length of the shell, said safety length of the shell being substantially equal to said initially protruding length of the shell.

* * * * *